United States Patent [19]

Lehnen

[11] 4,252,371

[45] Feb. 24, 1981

[54] LOUNGE CHAIR

[76] Inventor: James A. Lehnen, 84 Roosevelt Ave.,, Waterloo, Ontario, Canada

[21] Appl. No.: 35,513

[22] Filed: May 3, 1979

[51] Int. Cl.[3] ..... A47C 5/04

[52] U.S. Cl. ..... 297/421; 297/27; 297/39; 297/359; 297/418

[58] Field of Search ..... 297/27-29, 297/31, 35, 39-41, 78, 354, 360, 421, 355, 418, 411, 330

[56] References Cited

U.S. PATENT DOCUMENTS

| | | | |
|---|---|---|---|
| 532,676 | 1/1895 | Lovejoy | 297/78 X |
| 2,452,405 | 10/1948 | Vincent | 297/359 |
| 2,454,408 | 11/1948 | Roth | 297/418 X |
| 2,681,099 | 6/1954 | Vallone | 297/31 |
| 2,816,598 | 12/1957 | Shone | 297/40 |
| 3,047,334 | 7/1962 | Vanderpunden | 297/39 |
| 3,069,202 | 12/1962 | Gottfried et al. | 297/355 |
| 3,554,598 | 1/1971 | Dunkin | 297/330 |
| 3,806,192 | 4/1974 | Ohlogge | 297/330 X |

*Primary Examiner*—James T. McCall
*Attorney, Agent, or Firm*—Sim & McBurney

[57] ABSTRACT

There is provided a lounge chair with a seat portion and a back portion pivotally hinged to the seat portion. Two arm rest members are pivoted to the side edges of the back portion at intermediate locations, and a U-shaped support is provided for the forward ends of the arm rest members. The U-shaped support has a base member extending between two parallel upstanding side members, and the tops of the side members are pivoted to the arm rest members. The side members are further pivoted to the seat portion at intermediate locations, such that the base member is located in spaced arrangement under the seat portion. However, the U-shaped support is disposed such that its base member remains always clear of the ground, regardless of the attitude of the U-shaped support.

5 Claims, 8 Drawing Figures

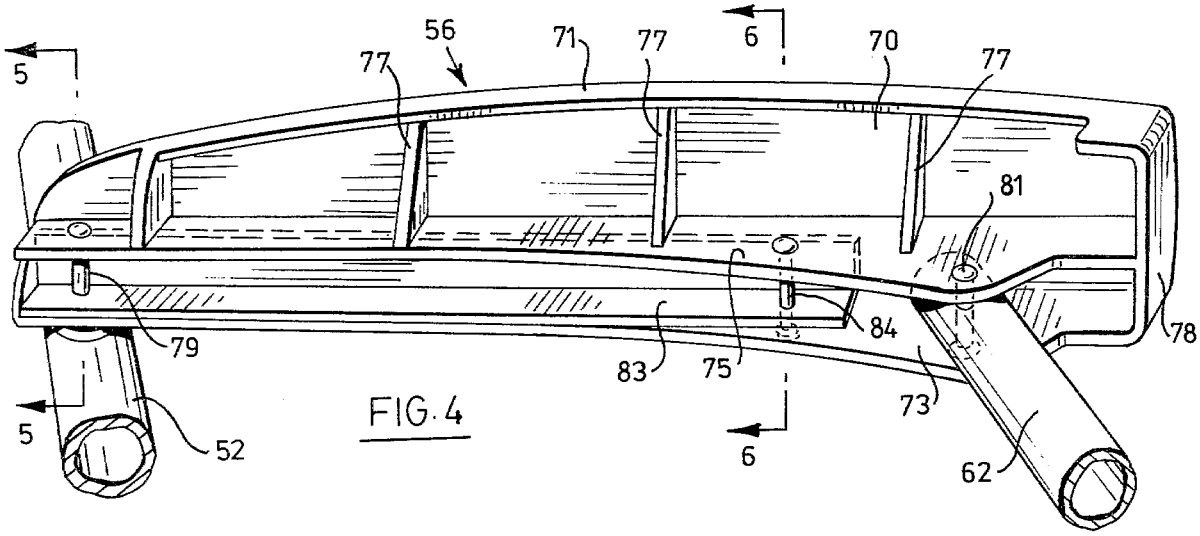
FIG. 4
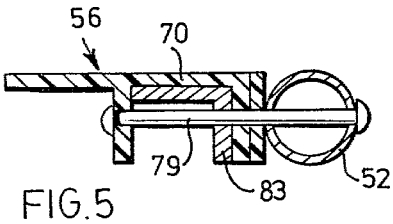
FIG. 5
FIG. 6
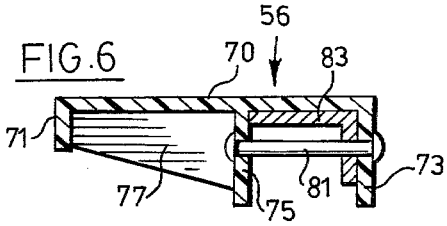
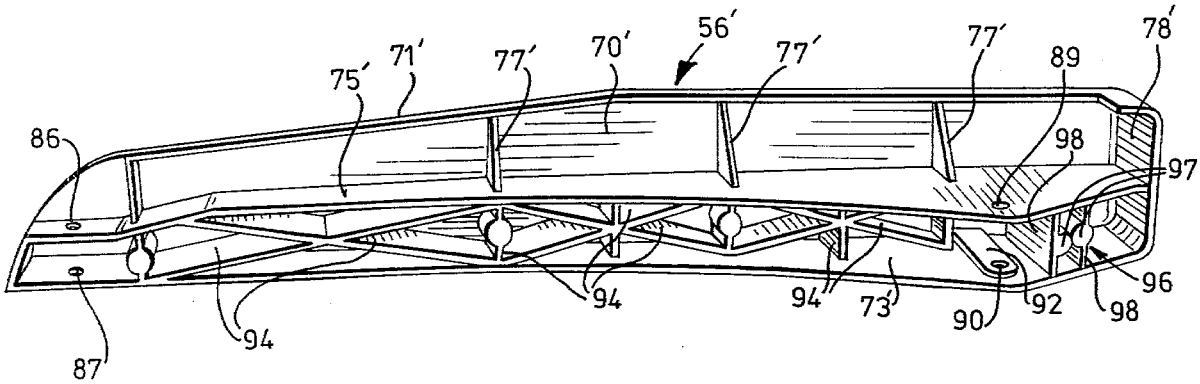
FIG. 7
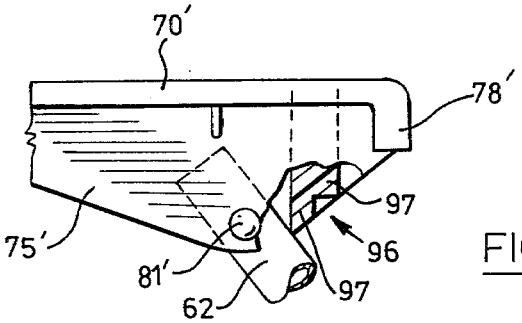
FIG. 8

LOUNGE CHAIR

This invention relates generally to patio furniture construction, and has to do particularly with an arm structure for lounge chairs.

BACKGROUND OF THIS INVENTION

Many patio or lounge chairs are presently marketed which consist of a back portion and a seat portion, these two portions being hingedly connected together in such a way that the back portion can assume any of a number of discrete angulated positions with respect to the horizontal. A particular form of hinging arrangement used in many conventional lounge chair constructions incorporates within the hinge itself a mechanism by which the back portion can be set to any of a number of discrete angles and will support the weight of the user while at that angle. The present invention is concerned not with the hinge per se, but with the possibility of providing an arm-rest structure on such a lounge chair, constructed in such a way that arm members extending from the back portion will always remain horizontal or substantially so, regardless of the angle of inclination of the back portion. Many currently available lounge chair constructions incorporate arm members which are pivoted to the back portion at the rearward ends thereof and are pivoted at the forward end to upward extensions from a leg mechanism for the lounge chair as a whole. Because the arm members are pivoted to and supported by extensions from the leg members, the forward ends of the arm members are always spaced upwardly above the seat portion of the lounge chair, regardless of the inclination of the back portion, due to the fact that the leg structure for the lounge chair cannot be allowed to fold out horizontally, for then the support for the lounge chair would be missing.

GENERAL DESCRIPTION OF THIS INVENTION

It is therefore an aspect of this invention to provide a lounge chair construction having arm rest means in which the arm rest members are capable of remaining in a horizontal or substantially horizontal position regardless of the angulation of the back portion of the lounge chair, and are constructed in such a way as to allow the back portion of a lounge chair to fold down into a flat or horizontal position in which it is aligned with the seat portion.

Accordingly, this invention provides a lounge chair comprising:

a seat portion having a rearward edge and leg means supporting the seat portion above the ground, a back portion having two side edges and a bottom edge, the back portion being pivotally hinged at its bottom edge to the rearward edge of the seat portion, two arm rest members pivoted to the side edges of the back portion at locations substantially equally distant from the bottom edge thereof, and a U-shaped support having a base member extending between two parallel side members, the side members having their ends remote from the base member pivoted to said arm rest members at locations spaced from the back portion, the side members being further pivoted to the seat portion at locations intermediate the ends of the side members, whereby the base member is located under the seat portion, the U-shaped support being disposed such that its base member remains clear of the ground in any attitude of the U-shaped support.

GENERAL DESCRIPTION OF THE DRAWINGS

One embodiment of this invention is illustrated in the accompanying drawings, in which like numerals denote like parts throughout the several views, and in which:

FIG. 4 is a view of one arm rest from underneath at the arrow marked by the number 4 in FIG. 1;

FIG. 5 is a sectional view taken at the line 5—5 in FIG. 4;

FIG. 6 is a sectional view taken at the line 6—6 in FIG. 4;

FIG. 7 is a view of a variant arm rest construction taken from underneath; and FIG. 8 is a partial elevational view of the front end of the arm rest construction of FIG. 7.

DETAILED DESCRIPTION OF THE DRAWINGS

Figures 1, 2, 3:
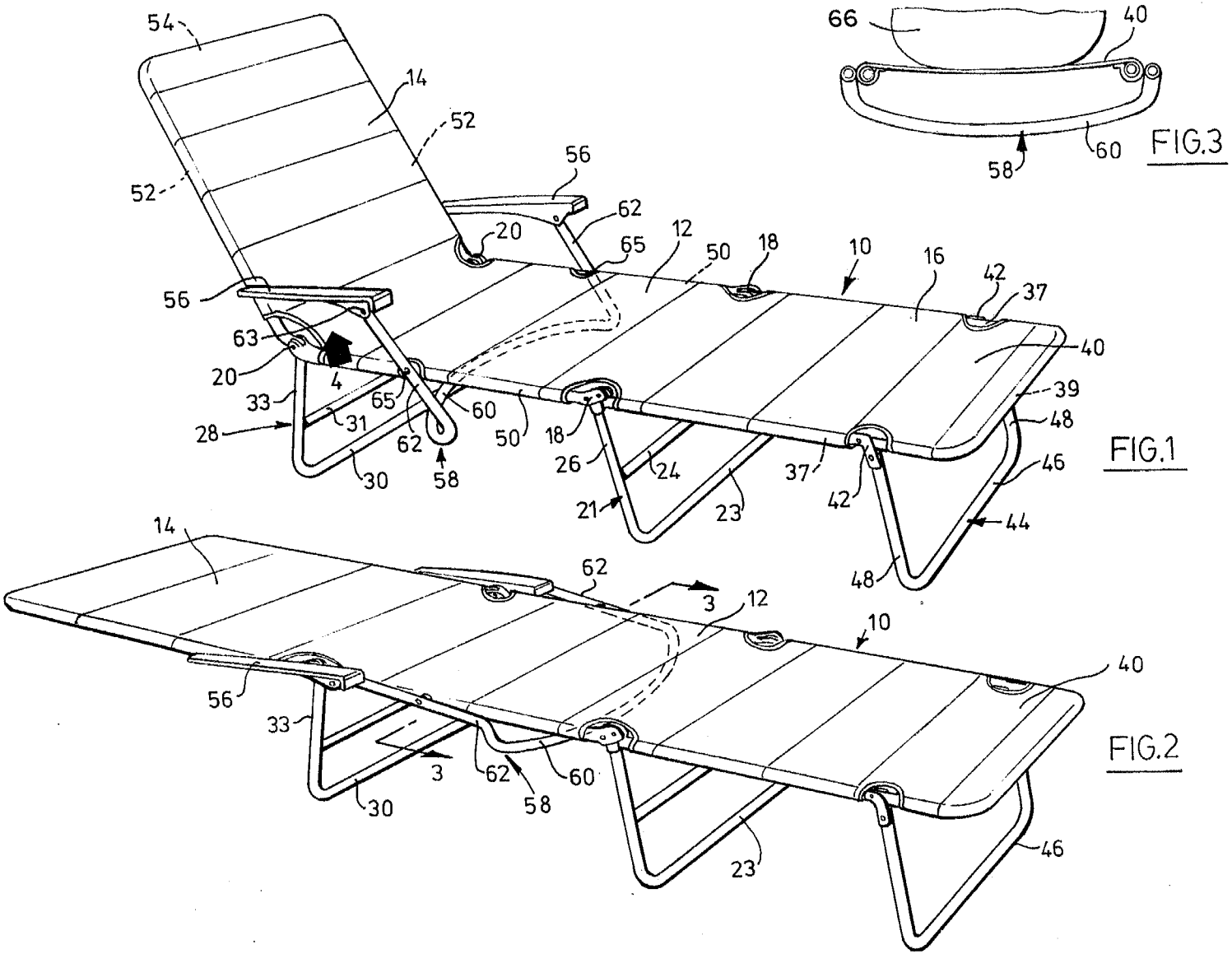
FIG. 1 is a perspective view of a lounge chair embodying the invention, with the back in angulated position.
FIG. 2 is a perspective view of the lounge chair of FIG. 1, with the back in horizontal position.
FIG. 3 is a sectional view taken at the line 3—3 in FIG. 2.

Attention is first directed to FIG. 1, which shows a lounge chair at 10, which includes a seat portion 12, a back portion 14, and a foot portion 16. The seat portion 12 is pivotally hinged to the foot portion 16 at forward hinges 18, and is pivotally hinged to the back portion 14 at rearward hinges 20. The hinges 18 and 20 are well known conventional hinges, and at least the rearward hinges 20 incorporate an internal feature by which the back portion 14 can be set into any one of a plurality of angulated positions with respect to the seat portion 12, such that it will remain in the selected position and support the weight of the user.

Extending downwardly from the forward hinges 18 is a forward ground support 21 which includes a bottom horizontal rail 23, an intermediate horizontal rail 24 and two side rails 26 (only one visible in FIG. 1).

Extending downwardly from the rearward hinges 20 is a rearward ground support 28 which includes a bottom horizontal rail 30, an intermediate horizontal rail 31 and two side rails 33 (only one visible in FIG. 1).

The foot portion of the lounge chair is defined by parallel bars 37 extending forwardly from the forward hinges 18, and a front bar 39 spanning between the parallel bars 37. In construction, the front bar 39 and the parallel bars 37 would be integral. In FIG. 1, the parallel bars 37, except for small portions thereof, are not visible due to being covered by a web-like material 40 which is strung between the bars 37. The front bar 39 is also covered by the material 40.

Spaced slightly inwardly from the front bar 39 are two hinge members 42 to which a front ground support 44 is connected. As can be seen in FIG. 1, the front ground support includes a bottom rail 46 and two side rails 48 extending upwardly from the ends of the bottom rail 46, the latter being horizontal. In construction, all parts of the front ground support would be integral.

The seat portion 12 of the lounge chair 10 is defined laterally by two parallel side bars 50, both of which are hidden except for small parts thereof by the webbing 40, which continues through the seat portion 12.

The back portion 14 is also defined by two side bars 52 and a top bar 54 which in actual construction would be integral with the side bars 52. The webbing 40 continues up the back portion 14 and hides most of the side bars 52 and all of the top bar 54 from sight in FIG. 1.

Also visible in FIG. 1 are two arm rest members 56, each of which is pivoted at its rear end to the side edges of the back portion 14 at locations substantially equally distant from the bottom edge of the back portion. A U-shaped support 58 is provided, and includes a base member 60 extending between two parallel side members 62. The tops of the side members (i.e. the ends remote from the base member 60) are pivoted to the arm rest members 56 at locations 63 spaced forwardly from the back portion 14. The side members 62 are further pivoted to the seat portion 12 at locations 65 intermediate the ends of the side members 62. By virtue of this construction, the base member 60 is located under the seat portion 12. It is essential to this invention that the U-shaped support 58 be disposed in such a way that its base member 60 remains clear of the ground at all times, and in any angular attitude of the U-shaped support 58.

It can be seen in FIGS. 1 and 2 that the side members 62, the arm rest members 56, the seat portion 12 and the back portion 14 define substantially a parallelegram linkage, in which the side members 62 are substantially parallel with the back portion 14, and in which the arm rest members 56 are substantially parallel with the seat portion 12. This will mean that the arm rest members 56 remain substantially parallel with the seat portion 12, i.e. substantially horizontal, regardless of the angular position of the back portion 14.

As can be seen in FIGS. 1, 2 and 3, the base member 60 of the U-shaped support 58 is curved toward the rear when the side members 62 are in a relatively upright position, and is curved toward the bottom (i.e. concave upwardly) when the side members 62 are relatively flat or horizontal. The concave upwardly curve of the base member 60 allows for some depression of the seat portion 12 due to the weight of the user of the lounge chair. It can be seen in FIG. 3 that the curve of the base member 60 keeps it appreciably below the level of the webbing 40 as depressed by the body 66 of the user of the lounge chair.

Attention is now directed to FIG. 4, for a detailed description of the construction of the arm rest members 56.

As can be seen in FIG. 4, which is a view from underneath, each arm rest member 56 includes a top wall 70, an outside wall 71, an inside wall 73, and an intermediate wall 75. Bridge supports 77 are provided at intervals between the outside wall 71 and the intermediate wall 75. A forward wall 78 joins the outside and inside walls 71 and 73, and has the intermediate wall 75 abutting thereagainst.

Shown at the left in FIG. 4 is a portion of the side bar 52 of the back portion 14, and shown at the right is the upper end of the respective side members 62 of the U-shaped support.

As can be seen in FIG. 4, a pin or rivet member 79 passing through the intermediate and inside walls 75 and 73 constitutes a pivot axis for the arm rest member 56 about the side bar 52. The upper end of the side member 62 extends between the walls 73 and 75, and is pivoted thereto by means of a pin or rivet member 81.

Extending longitudinally of the arm rest 56 between the walls 73 and 75 is a metal reinforcement beam 83, of L-shaped cross section, which is secured in place by the rivet 79 and by a further rivet 84 extending between the walls 73 and 75.

FIGS. 5 and 6 illustrate the sections through the rivets 79 and 81, respectively.

Attention is now directed to FIGS. 7 and 8, showing a variant of the arm rest construction.

In FIG. 7, the arm rest member 56' is similar to the arm rest member 56 shown in FIG. 4, except that the metal reinforcement beam 83 in FIG. 4 is absent in FIG. 7. In order to provide the requisite strength for the arm rest member 56' shown in FIG. 7, an integral structure is moulded in a manner which is easily seen in FIG. 7. The arm rest member 56' is preferably a moulded plastic item, and includes a top wall 70', an outside wall 71', an inside wall 73', and an intermediate wall 75'. Bridge supports 77' are provided at intervals between the outside wall 71' and the intermediate wall 75'. A forward wall 78' joins the outside and inside walls 71' and 73', and has the intermediate wall 75' abutting thereagainst.

At the lefthand or rear portion of the arm rest member 70', two aligned apertures 86 and 87 are located in the intermediate wall 75' and the inside wall 73', respectively. The aligned apertures 86 and 87 are adapted to receive a rivet similar to the rivet 79 shown in FIG. 4, the purpose of the rivet being to pivot the arm rest member 56' to the respective side bar 52 of the back portion 14 (see FIG. 1 for these numerals).

Toward the forward or rightward end of the arm rest member 56' in FIG. 7, the intermediate wall 75' and the inner wall 73' again have two aligned apertures 89 and 90, the purpose of which is to receive a second rivet similar to the rivet 81 seen in FIG. 4. The purpose of the rivet 81 is to pivot the arm rest member 56' to the upper end of the respective side bar member 62, which end extends between the walls 73' and 75'. In FIG. 7, the inner wall 73' is thickened integrally at 92 for increased strength.

Extending in the general region between the apertures 86, 87 and the apertures 89, 90, and between the intermediate wall 75' and the inner wall 73', are integral reinforcing webs 94, provided in crossing or star-like formations. The webs have a greater dimension in a vertical plane, and a smaller dimension in a transverse or horizontal plane (imagining that the arm rest member 56' is oriented with its top wall 70' horizontal).

Immediately forwardly (rightwardly) of the apertures 89, 90 in FIG. 7 is located an integral guard structure 96, which extends downwardly from the top wall 70' to a location such that, when the arm rest member 56' is pivoted to the respective side member 62, little if any room is left between the side member 62 and the guard structure 96 for the fingers of the user to be entrapped. As is best seen in FIG. 7, the guard structure 96 includes two parallel, contacting and integral ribs 97, each of which is integral with a transverse plate member 98. The plate members 98 extend between the intermediate wall 75' and the inner wall 73'.

Due to the plate members 98, the guard structure 96 is relatively resilient, such that, as the back portion 14 of the lounge chair is pivoted from the FIG. 1 position to the FIG. 2 position, any mechanical interference between the side member 62 and the guard structure 96 will not cause breakage or rupture of any of the parts, because the guard structure 96 is able to resiliently distort out of the way of the pivoting side member 62.

I claim:

1. A lounge chair comprising:

a seat portion having a rearward edge and leg means supporting the seat portion in a fixed position above the ground, a back portion having two side edges and a bottom edge, the back portion being pivotally hinged at its bottom edge to the rearward edge of the seat portion, and being capable of pivoting rearwardly, two arm rest members pivoted to the side edges of the back portion at locations substantially equally distant from the bottom edge thereof, and a U-shaped support distinct from said leg means, said U-shaped support having a base member extending between two parallel side members, the side members having their ends remote from the base member pivoted to said arm rest members at locations spaced from the back portion, the side members being further pivoted to the seat portion at locations intermediate the ends of the side members, whereby the base member is located under the seat portion, the distance from said locations to the said base member being less than the vertical distance from the seat portion to the ground, so that the base member of the U-shaped support remains clear of the ground in any attitude of the U-shaped support.

2. The lounge chair claimed in claim 1, in which said side members are substantially parallel with said back portion, and in which said arm rest members are substantially parallel with said seat portion.

3. The lounge chair claimed in claim 1, in which said side members, said arm rest members, said seat portion and said back portion define a parallelogram linkage.

4. The lounge chair claimed in claim 1 or claim 2, in which the base member is curved convexly toward the rear, as seen when the side members are vertical, such that when the back portion pivots rearwardly toward a horizontal position, the base member swings up under the seat portion and its curve is concave upwardly, thereby allowing for some depression of the seat portion due to the weight of the user of the lounge chair.

5. The lounge chair claimed in claim 4, in which said leg means are located forwardly and rearwardly of the locations at which said side members are pivoted to the seat portion.

* * * * *